United States Patent [19]

Spencer et al.

[11] 3,973,359

[45] Aug. 10, 1976

[54] WEB ABRADING ASSEMBLY

[75] Inventors: John Spencer, Worcester; Ferdinand Ruepp, Linwood; Robert Whewell, Northboro, all of Mass.

[73] Assignee: David Gessner Company, Worcester, Mass.

[22] Filed: June 23, 1975

[21] Appl. No.: 589,413

[52] U.S. Cl. ..... 51/75; 26/28; 51/206.5; 51/273

[51] Int. Cl.[2] ..... B24B 7/12; B24B 55/06; D06C 11/00

[58] Field of Search ..... 51/74 R, 75, 90, 206.4, 51/206.5, 352, 353, 273; 26/28, 29 R, 29 P, 33–39

[56] References Cited

UNITED STATES PATENTS

| | | | |
|---|---|---|---|
| 458,725 | 9/1891 | Forrester | 26/35 |
| 647,323 | 4/1900 | O'Brien | 26/29 P |
| 1,218,131 | 3/1917 | Tomlinson | 26/28 |
| 2,220,627 | 11/1940 | Sperry | 26/28 |
| 2,781,555 | 2/1957 | MacHenry | 51/75 X |

FOREIGN PATENTS OR APPLICATIONS

| | | | |
|---|---|---|---|
| 22,100 | 10/1915 | United Kingdom | 26/28 |

OTHER PUBLICATIONS

Mario Crosta Advertizing Bulletin, Sueding Machine, Oct. 1973.

*Primary Examiner*—Al Lawrence Smith
*Assistant Examiner*—Nicholas P. Godici

[57] ABSTRACT

Apparatus for abrading fabric traveling along a directed path of travel having a plurality of cylindrical members covered with a fabric abrading surface circumferentially supported and spaced from each other for contacting and abrading fabric and means for releasably securing the cylindrical members when the abrading surface is worn to expose unworn fabric abrading surfaces to the traveling fabric.

5 Claims, 4 Drawing Figures

WEB ABRADING ASSEMBLY

BACKGROUND, OBJECTIVES AND ADVANTAGES OF THE INVENTION

Many textile fabrics are treated after they have been woven or knitted to provide suitable surface effects whether by napping or abrading. In some applications, the yarns are raised above the base of the fabric to form a pile surface or the fibers of the yarns may be ruptured depending upon the nature of the yarns whether made of staple or continuous filaments as in the case of multifilament synthetic yarns. In the use of an abrading surface, whether sandpaper or wire clothing or a knurled surface, such surfaces become worn after extended use depending upon the abrasion characteristics of the fabrics being finished.

Some denim fabrics that are relatively coarse have been abraded using rollers covered by sandpaper and frequent replacement of the sandpaper covering the supporting drum or roll has been necessary. When synthetic fibers including nylon or polyester have been employed, as opposed to all cotton fibers, increased abrasion and wear is encountered necessitating more frequent maintenance and replacement of the abrading surface material.

It is an objective of this invention to provide an apparatus for abrading fabric traveling along a directed path of travel in which at least one roller assembly is provided having a series of fabric contacting surfaces to abrade the traveling fabric.

Another objective of this invention is to provide an apparatus for abrading traveling fabric to impart desired finishing characteristics to at least one of the surfaces thereof in which the abrading apparatus has a plurality of incrementally changeable surfaces to be exposed when one or more surfaces have become worn.

Yet another objective of this invention is to provide a fabric abrading machine having a plurality of fabric abrading rolls which are spaced from each other along the path of fabric travel in which each roll is provided with a plurality of independent fabric engaging abrading surfaces which surfaces may be rotated when worn.

Still another objective of this invention is the provision of an apparatus in the form of a rotating assembly having a series of circumferentially and radially supported and spaced abrading surfaces which may be modified when worn in the path of fabric travel with relative ease and a minimum of labor.

Other objectives and many of the attendant advantages of this invention will become more readily apparent to those skilled in the art of fabric finishing from the following figure description and detailed description of one preferred embodiment of the invention.

IN THE DRAWING

DETAILED DESCRIPTION OF ONE PREFERRED EMBODIMENT OF THE INVENTION

Figures 1, 2, 3, 4:
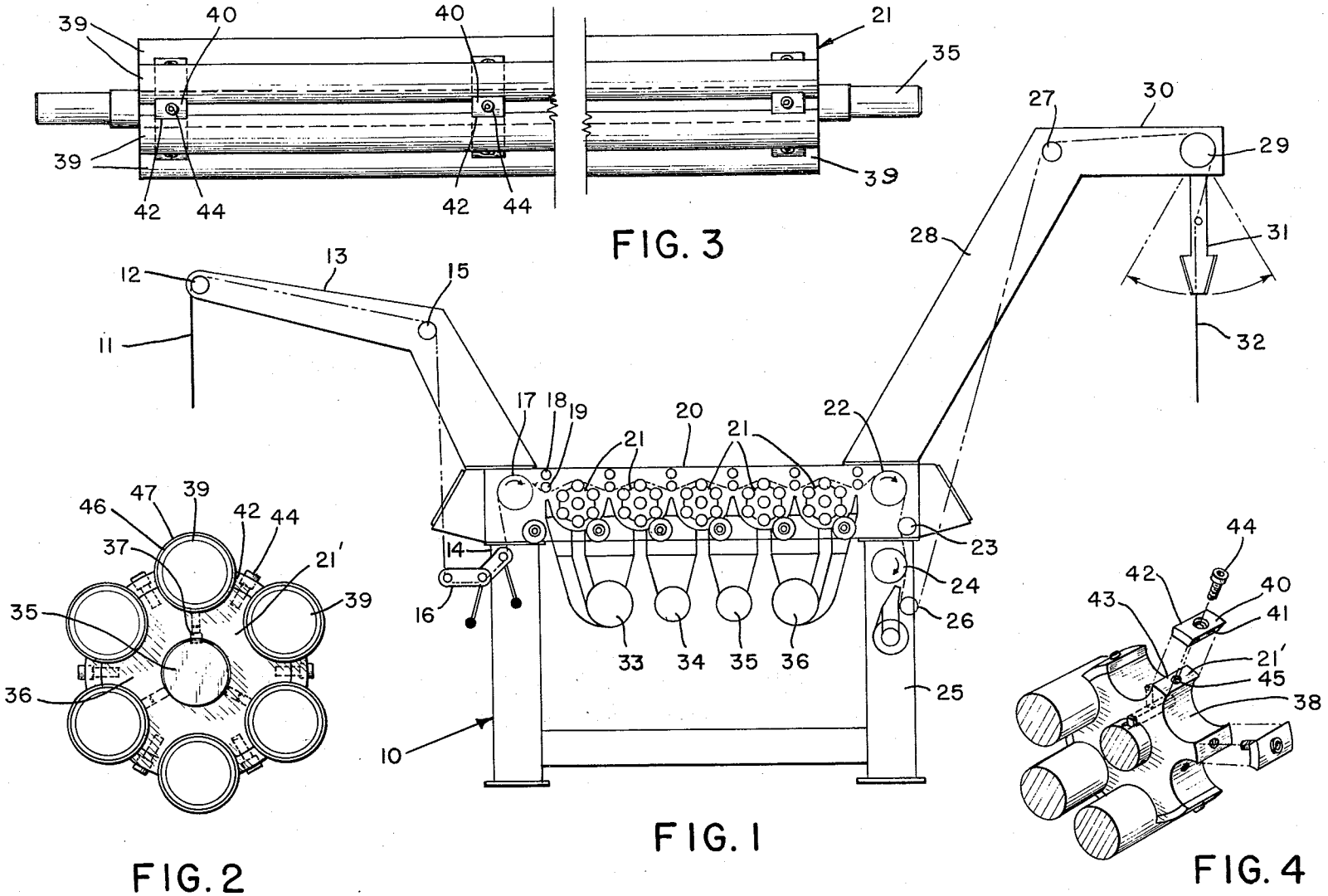
FIG. 1 is a side elevational view of a fabric abrading machine showing the path of travel of the fabric and a plurality of fabric abrading devices in position for abrading the traveling fabric in its path of travel from inlet to discharge.
FIG. 2 is an enlarged and elevational view of one of the fabric abrading rolls illustrating a plurality of individual cylindrical tubular members supporting an abrading surface.
FIG. 3 is a top plan view with a medial section removed from one of the roll assemblies.
FIG. 4 is a partial perspective view of one portion of the roll assembly in exploded perspective illustrating the various elements in one portion of the assembly.

There is illustrated in FIG. 1 of the drawing an apparatus 10 for abrading a continuously moving textile web of fabric 11 which enters the apparatus over the inlet roller and the guide 12 supported on the upstanding arm 13 that is mounted on the machine frame 14. A second guide roll 15 is supported in spaced relation to the roll 12 to guide the fabric 11 in its directed path of travel downwardly to the cloth tensioner and spreader assembly 16 whereby the tension in the traveling fabric may be suitably modified. The fabric is then guided upwardly over the front feed roll 17 that is driven by a conventional variable drive mechanism (not shown). A series of idler and cloth hold down rolls 18 and 19 is spaced longitudinally throughout the machine at spaced intervals to guide and hold a fabric in its directed path of travel through the housing 20 in which the fabric is abraded as it travels therethrough to be engaged by a series of rotatably mounted and driven fabric abrading assemblies 21, one of which will be described hereinafter in detail.

As the abraded fabric is finished from the last of the series of abrading assemblies 21, the fabric will pass over the rear feed roll 22 and the guide roll 23 as it descends to a cleaning brush 24 that is rotatably mounted in the vertical leg 25 of the machine frame. The brushed fabric that has been abraded passes around the guide roll 26 before the fabric reaches upwardly to pass over the guide roll 27 supported on the upstanding arm 28 mounted on the machine frame. An exit roll 29 is positioned on the cantilever portion 30 of the arm 28 beneath which is an oscillating folder assembly 31 of conventional construction through which the finished fabric 32 is guided downwardly for folding into a receptacle (not shown).

It is desirable for the abrading machine 10 to be provided with a series of collection ducts 33, 34, 35 and 36 which ducts will be provided with appropriate suction or vacuum (not shown) to remove the abraded fibers and other materials in the abrading process as the ducts 34–36 are connected by suitable lines to collect abraded fibers adjacent to the abrading assemblies 21.

Since each of the abrading assemblies 21 is substantially identical, only one such unit will be described in detail. There is shown in FIG. 3 a partial longitudinal view of an abrading assembly 21 in which there is a driven shaft 35 on which there is mounted a series of supporting plates 21′ axially spaced from each other and securely mounted on the shaft 35 with each of the plates 21′ being secured on the shaft 35 by means of the key 37 to prevent relative rotation between the shaft and the plate 21′. As shown in FIG. 4, plate 21′ is provided with circumferentially spaced-apart arcuate grooves 38 for cooperatively receiving and seating an individual cylindrical member 39 therein. A cylindrical member retaining lug 40 having arcuate sides 41 and 42 is secured to the plate 21′ on the arcuate surface 43 by means of the retaining screw 44.

There is illustrated in FIG. 2 a cross-sectional view of an abrading assembly in which the series of cylindrical members 39 is shown mounted in position within the grooves 38 in the plate 21′ and secured in position by the lugs 42 which are bolted in position by the threaded engagement of the screws 44 in the threaded opening 45 on the surface 43 of the plate 21'. Each cylindrical member 39 is provided with an abrasive covering 46 that is wound therearound whether as a single strip or a sleeve with the outer surface 47 being provided with suitable abrading material or grit depending upon the action to be taken by the abrading material and the fabric to be abraded.

In operation, each of the abrading assemblies 21 will be driven through a single drive motor (not shown) and a connecting driving means (not shown) whereby the shaft 35 will revolve and in turn each of the abrading members 39 will engage the traveling fabric 11 in its path of travel through the machine by contacting one surface thereof with the exposed abrading surfaces on the abrading assemblies 21.

As shown in FIG. 1, the flight of the fabric in its directed path of travel from one abrading assembly 21 to the next in the series or sequence will cause the contacting exposed surfaces of the abrading material 47 wrapped or enveloped around the cylindrical members 39 to engage the traveling fabric to produce the desired finishing surface. When it is observed that the fabric surface has not been finished properly, and the abrading surfaces 47 have become worn, the machine may be stopped and each of the abrading assemblies 21 may then be modified by loosening the screws 42 and the lugs 40 at each position sufficiently to permit each of the cylindrical members 39 to be rotated sufficiently to expose an unworn surface 47 of the abrading material. The extent of rotation of the cylindrical members will depend upon the arc of the contact and wear of the exposed abrading surface to the fabric. Once the cylindrical members have been repositioned to expose unworn abrading surfaces, the screws 44 may be tightened to have the lugs 40 seat the cylindrical members in sequence within the arcuate seats 38 in the retaining plate 21'. The sequence for each of the abrading assemblies is the same. However, it will be readily appreciated that one cylindrical member at a time may be loosened, rotated and then tightened in position as opposed to loosening all of the members initially and then rotating each of the member individually, and then tightening all of the members in position.

As stated previously, the abrading material may vary considerably depending upon the fabric finishing function to be performed and the abrading material may be a sleeve that may be slid over the cylindrical supporting member 39 and suitably secured whether by adhesive or other means, or a band of abrading material may be suitably wrapped around the cylindrical surface of the member 39 suitably secured therearound. In some applications, the cylindrical surface may be sprayed with a suitable adhesive and grit having the desired adhesion and fineness respectively.

Other modifications for applying the adhesive to the cylindrical surfaces of the cylindrical members 39 are contemplated for utilization with the abrading assemblies as well as variations in abrading properties may be sequentially modified from one assembly to the next in the path of fabric travel from inlet to exit.

We claim:

1. Apparatus for abrading a continuous web of material forming an abrading assembly comprising a shaft, cylindrical member supporting means mounted on said shaft, a plurality of cylindrical members circumferentially spaced from each other and equally radially spaced from said shaft mounted on said cylindrical member supporting means, and abrasive means on said cylindrical members to engage and abrade a continuous web of material upon shaft rotation and means on said cylindrical member supporting means for releasably engaging said cylindrical members for wear adjustments whereby said members abrade in non-rotatable engagement with said supporting means.

2. Apparatus for abrading a continuous web of material forming an abrading assembly as claimed in claim 1, said cylindrical members supporting members having arcuate portions for cooperatively receiving and seating said cylindrical members.

3. Apparatus for abrading a continuous web of material forming an abrading assembly as claimed in claim 1, and a series of at least five of said abrading assemblies positioned adjacent to each other for cooperation to engage a continuous web of material in its directed path of travel to abrade one surface thereof, and means for collecting abraded material from said web adjacent said abrading assemblies.

4. Apparatus for abrading a continuous web of material forming an abrading assembly as claimed in claim 1, said abrasive means enveloping the cylindrical member and secured thereto, said abrasive means having grit bounded thereto for engaging the web to be finished.

5. Apparatus for abrading a continuous web of material forming an abrading assembly as claimed in claim 1, said abrasive means being directly applied to the cylindrical members.

* * * * *